US010802416B1

(12) United States Patent
Watanabe et al.

(10) Patent No.: US 10,802,416 B1
(45) Date of Patent: Oct. 13, 2020

(54) PRINT HEAD AND IMAGE FORMING APPARATUS

(71) Applicant: TOSHIBA TEC KABUSHIKI KAISHA, Shinagawa-ku, Tokyo (JP)

(72) Inventors: Takeshi Watanabe, Yokohama Kanagawa (JP); Koji Tanimoto, Kannami Tagata Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/515,084

(22) Filed: Jul. 18, 2019

(51) Int. Cl.
*G03G 15/043* (2006.01)

(52) U.S. Cl.
CPC ..... *G03G 15/043* (2013.01)

(58) Field of Classification Search
CPC ..... G03G 15/043
See application file for complete search history.

(56) References Cited

U.S. PATENT DOCUMENTS 5,150,156 A * 9/1992 Koyama ..... G03G 15/045 399/156
2006/0139434 A1* 6/2006 Kurose ..... G06K 15/12 347/183
2006/0192834 A1* 8/2006 Tsujino ..... G03G 15/326 347/119
2018/0288266 A1* 10/2018 Watanabe ..... G09G 3/3233

FOREIGN PATENT DOCUMENTS

JP 2017-170810 9/2017

* cited by examiner

*Primary Examiner* — Sandra Brase
(74) *Attorney, Agent, or Firm* — Amin, Turocy & Watson, LLP

(57) ABSTRACT

In accordance with an embodiment, an image forming apparatus comprises a light emitting element array comprising a low temperature polysilicon transistor and a plurality of light emitting elements that emit light at luminance corresponding to an output current of the transistor; and a processor configured to select either one of a first mode in which the light emitting element emits light for a first irradiation time at a first light quantity per unit area and a second mode in which the light emitting element emits light for a second irradiation time longer than the first irradiation time at a second light quantity less than the first light quantity per unit area, and control emission of light from the plurality of light emitting elements to expose a photoconductor according to acquired image data and a selected mode.

20 Claims, 8 Drawing Sheets

| | DENSITY UNEVENNESS IN HALFTONE | DECREASE IN LIGHT QUANTITY AFTER PRINTING OF 100,000 SHEETS |
|---|---|---|
| FIRST MODE | NONE | 1% |
| SECOND MODE | PRESENT | <0.1% |

PRINT HEAD AND IMAGE FORMING APPARATUS

FIELD

Embodiments described herein relate generally to a print head and an image forming apparatus and associated methods.

BACKGROUND

In recent years, in an electrophotographic apparatus, a small exposure device such as an LED (Light Emitting Diode) (hereinafter, referred to as an "LED print head") is widely used. However, since the LED print head has a complicated configuration and is manufactured by arranging chips side by side, a position accuracy thereof is limited.

For this reason, an exposure device including organic EL (Electroluminescence) as a luminescence material (hereinafter, referred to as "organic EL print head") is noted. The organic EL print head is manufactured by applying organic EL luminescence material to a low temperature polycrystalline silicon thin film transistor formed on one glass plate, sealing them, and finally cutting them from the one glass plate. Therefore, the organic EL print head is noted as a high-precision and inexpensive print head.

DETAILED DESCRIPTION

Hereinafter, several embodiments are described with reference to the accompanying drawings.

First, with reference to FIG. 1 to FIG. 8, configurations of a print head and an image forming apparatus provided with the print head according to an embodiment are described. Next, with reference to FIG. 9, a light emitting control of a light emitting element of the print head and an image formation by the image forming apparatus according to the embodiment are described. Then, image quality improvement due to the control of emission of light from the light emitting element of the print head and the image formation by the image forming apparatus according to the embodiment is described with reference to FIG. 10 to FIG. 13.

[Configuration]

Figure 1:
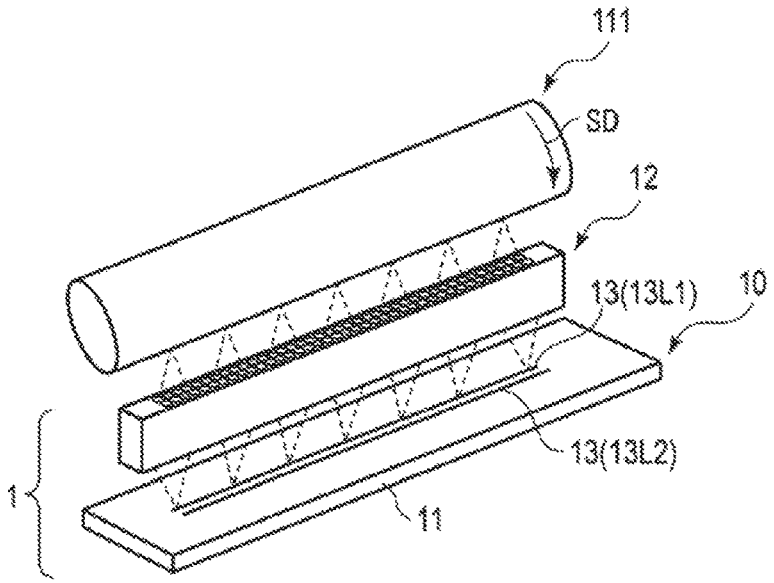
FIG. 1 is a diagram illustrating a positional relationship between an organic photoconductor and a print head in an image forming apparatus according to an embodiment.

FIG. 1 is a diagram illustrating a positional relationship between an organic photoconductor and the print head in the image forming apparatus according to the embodiment. For example, the image forming apparatus such as a printer, a copying machine or a multifunction peripheral includes an organic photoconductor 111 shown in FIG. 1. A print head 1 is an organic EL print head using an organic EL luminescence material, and is arranged to face the organic photoconductor 111.

The organic photoconductor 111 rotates in a direction indicated by an arrow shown in FIG. 1. The rotation direction is referred to as a sub scanning direction SD. The organic photoconductor 111 is uniformly charged by a charger and exposed with light from the print head 1, whereby a potential of an exposure portion is lowered. Specifically, by controlling emission of light and non-emission of light from the print head 1, an electrostatic latent image can be formed on the organic photoconductor 111.

The print head 1 comprises a light emitting section 10 and a rod lens array 12. The light emitting section 10 includes a transparent substrate 11. For example, the transparent substrate 11 is a glass substrate through which light is transmitted. On the transparent substrate 11, light emitting element arrays 13 each composed of, for example, a plurality of light emitting elements are formed in one row or a plurality of rows. FIG. 1 shows an example in which two rows, i.e., a first light emitting element array 13L1 and a second light emitting element array 13L2, are formed in parallel with each other.

Figure 2:
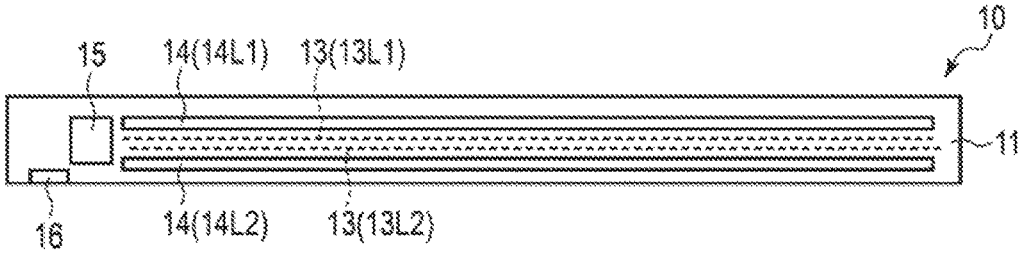
FIG. 2 is a diagram illustrating a transparent substrate constituting the print head according to the embodiment.

FIG. 2 is a diagram illustrating a transparent substrate constituting the print head according to the embodiment. As shown in FIG. 2, at the center on the transparent substrate 11, two light emitting element arrays 13 (i.e., the first light emitting element array 13L1 and the second light emitting element array 13L2) are formed along a longitudinal direction of the transparent substrate 11. In the vicinity of the light emitting element array 13, DRV circuit arrays 14 (i.e., a first DRV circuit array 14L1 and a second DRV circuit array 14L2) for respectively driving the light emitting elements (i.e., enabling the light emitting elements to emit light) are formed.

In FIG. 2, the DRV circuit arrays 14 for driving the light emitting elements (i.e., enabling the light emitting elements to emit light) are arranged on both sides of the two light emitting element arrays 13; however, the DRV circuit arrays 14 may be arranged on one side.

An IC (Integrated Circuit) 15 is arranged at an end of the transparent substrate 11. The IC 15 is described in detail below. The transparent substrate 11 includes a connector 16. The connector 16 electrically connects the print head 1 with a control system of the printer, the copying machine or the multifunction peripheral. Supply of electric power, head control, transfer of image data, and the like are enabled through such connection. The transparent substrate 11 is provided with a substrate for sealing the light emitting element array 13, the DRV circuit array 14 and the like to prevent them from being exposed to the air.

Figure 3:
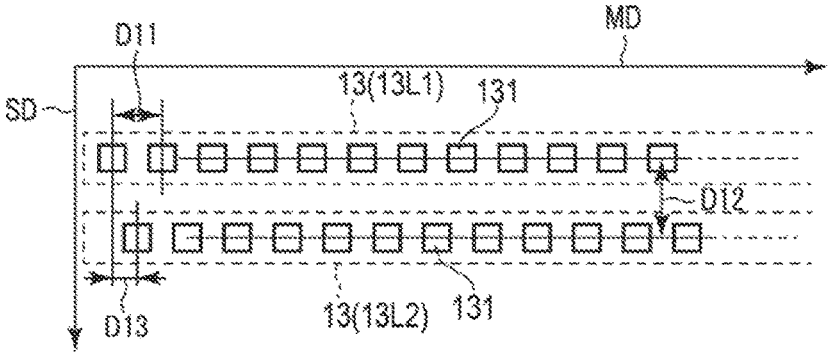
FIG. 3 is a diagram illustrating a light emitting element array (two-row head) according to the embodiment.

FIG. 3 is a diagram illustrating the light emitting element array (two-row head) according to the embodiment. As shown in FIG. 3, each light emitting element array 13 (i.e., either one of the first light emitting element array 13L1 and the second light emitting element array 13L2) includes a plurality of light emitting elements 131 arranged in a main scanning direction MD perpendicular to a rotation direction of the organic photoconductor 111 (the sub scanning direction SD). In other words, the plurality of light emitting elements 131 forming the light emitting element array 13 in the first row and the plurality of light emitting elements 131 forming the light emitting element array 13 in the second row are parallel to the main scanning direction MD.

The light emitting element 131 is, for example, a square with a side length of 20 μm. An arrangement interval D11 of the light emitting element 131 is, for example, a pitch of about 42.3 μm at which a resolution thereof becomes 600 dpi. In other words, the plurality of light emitting elements 131 included in the second light emitting element array 13L2 is arranged at a certain interval (arrangement interval D11) along the main scanning direction with respect to the plurality of light emitting elements included in the first light emitting element array 13L1.

The light emitting element array 13 in the first row and the light emitting element array 13 in the second row are arranged at an interval D12 in the sub scanning direction SD. Furthermore, the light emitting elements 131 forming the light emitting element array 13 in the first row and the light emitting elements 131 forming the light emitting element array 13 in the second row are deviated from each other by a predetermined pitch D13 in the main scanning direction MD. For example, the predetermined pitch D13 is half of the arrangement interval D11. In this way, the two light emitting element arrays 13 are arranged in a staggered manner.

If the light emitting elements forming the light emitting element arrays 13 in the first and second rows emit light at the same timing, a staggered exposure pattern is formed on the organic photoconductor 111. By setting a row on an upstream side in the rotation direction of the organic photoconductor 111 as the first row and a row on a downstream side thereof as the second row, a control section (control section 174 in FIG. 8) described below controls the light emitting element array 13 in the first row and the light emitting element array 13 in the second row to emit light at different timings according to a rotation speed of the organic photoconductor 111 and the distance D12. Specifically, according to the rotation speed of the organic photoconductor 111 and the distance D12, the control section 174 delays a light emitting timing of the light emitting element array 13 in the second row by a certain time period with respect to the light emitting element array 13 in the first row. In other words, the control section 174 outputs first light emitting element image data to the light emitting element array 13 in the first row and second light emitting element image data to the light emitting element array 13 in the second row at different timings according to the rotation speed of the organic photoconductor 111 and the distance D12. Here, the first light emitting element image data and the second light emitting element image data correspond to image data in each line in the main scanning direction. In this way, a latent image at a resolution of 1200 dpi is formed on the organic photoconductor.

Thus, the control section 174 controls the light emitting timing (transfer timing of the image data) of the plurality of light emitting element arrays 13, and in this way, an image with high density can be generated. In the case of two light emitting element arrays 13, an image with high density twice the density of the light emitting element 131 in one row can be generated. In the case of n (n 3, n: integer) light emitting element arrays 13, an image with high density n times the density of the light emitting element 131 in one row can be generated.

Figure 4:
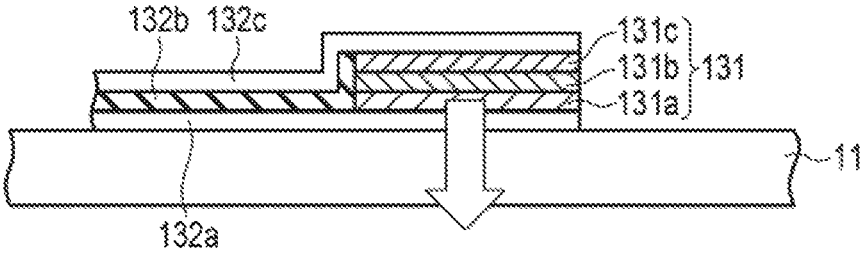
FIG. 4 is a diagram illustrating a structure of a light emitting element according to the embodiment.

FIG. 4 is a diagram illustrating an example of a structure of the light emitting element according to the embodiment. In FIG. 4, the substrate for sealing is omitted. As shown in FIG. 4, the light emitting element 131 includes a hole transport layer 131*a*, a light emitting layer 131*b*, and an electron transport layer 131*c*, and the light emitting element 131 is sandwiched by an electrode (+) 132*a* and an electrode (−) 132*c* insulated by an insulating layer 132*b* in a state of contacting the electrode (+) 132*a* and the electrode (−) 132*c*. In the present embodiment, for example, the light emitting layer 131*b* is an organic EL. The electrode (−) 132*c* reflects the light emitted from the light emitting layer 131*b*. With such a structure, the light emitted from the light emitting layer 131*b* is output to the transparent substrate 11 side.

Figure 5:
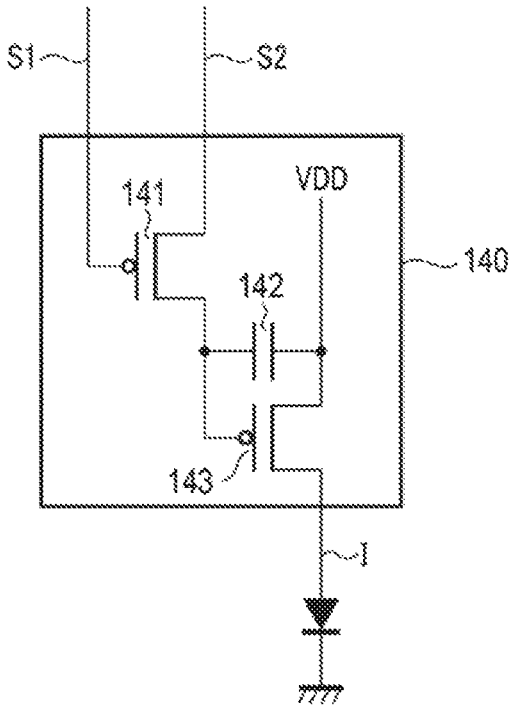
FIG. 5 is a diagram illustrating a DRV circuit for driving the light emitting element according to the embodiment.

FIG. 5 is a diagram illustrating the DRV circuit for driving the light emitting element according to the embodiment. The DRV circuit is constituted by a low temperature polycrystalline silicon thin film transistor. A selection signal S1 becomes "L" level at the time of changing the light emitting intensity of the light emitting element 131 connected to the DRV circuit 140. At the time the selection signal S1 becomes "L" level, a voltage of a capacitor 142 changes according to the voltage of a light emitting level signal S2.

At the time the selection signal S1 becomes "H" level, the voltage of the capacitor 142 is held. Even if the voltage of the light emitting level signal S2 changes, the voltage level of the capacitor 142 does not change. A current corresponding to the voltage held in the capacitor 142 flows through the light emitting element 131 connected to a signal line I of the DRV circuit 140. A predetermined light emitting element 131 is selected from the plurality of light emitting elements 131 included in the light emitting element array 13 according to the selection signal S1, and the light emitting intensity thereof is determined according to the light emitting level signal S2, and in this way, the light emitting intensity thereof can be maintained.

Figure 6:
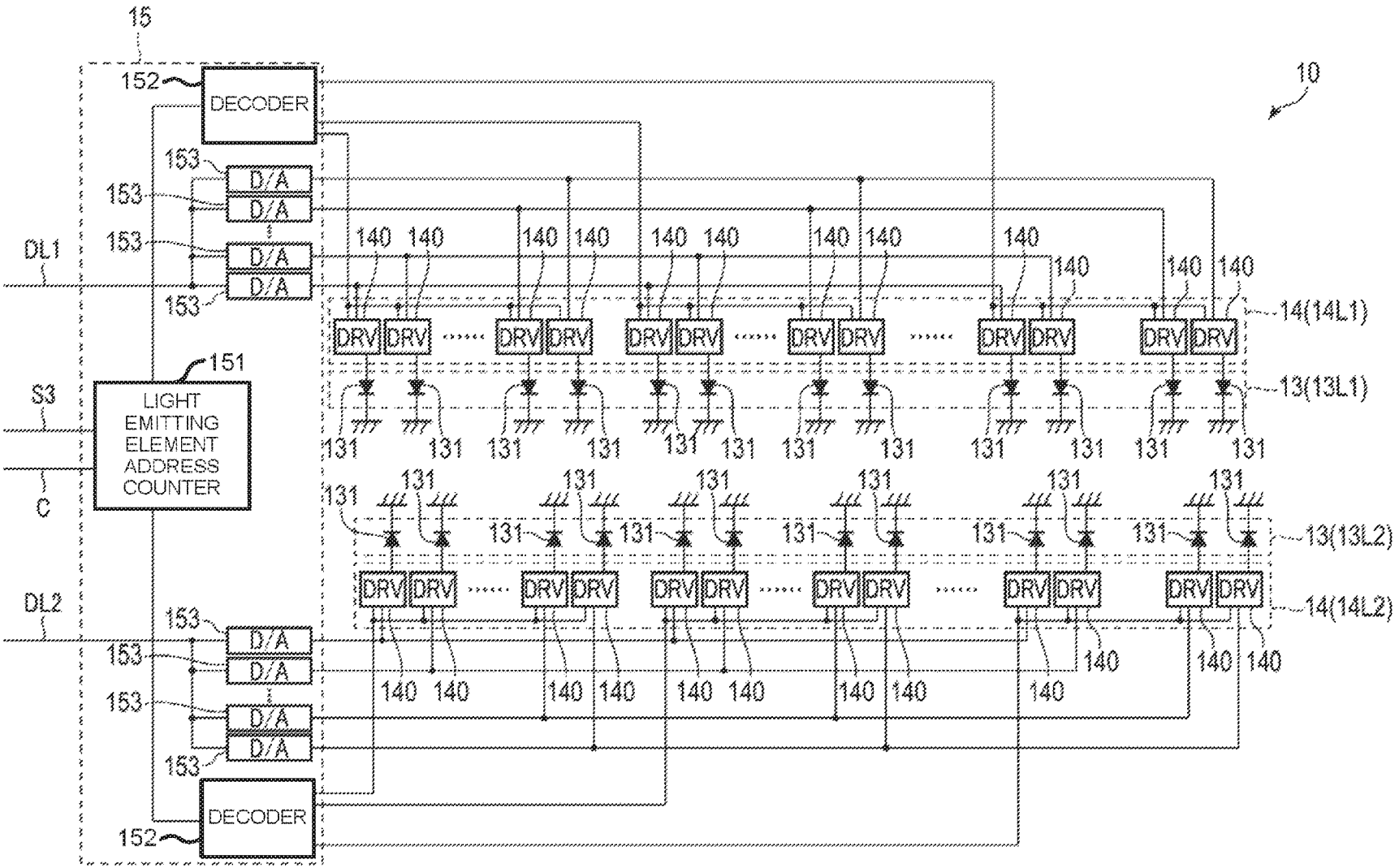
FIG. 6 is a diagram illustrating an example of a head circuit block of the print head according to the embodiment.

FIG. 6 is a diagram illustrating a head circuit block of the print head according to the embodiment. As shown in FIG. 6, the light emitting section 10 includes a head circuit block, and the head circuit block includes a light emitting element address counter 151, a decoder 152 and a D/A (digital to analog) conversion circuit 153. The light emitting element address counter 151, the decoder 152 and the D/A conversion circuit 153 supply a signal for controlling the light emitting intensity and ON/OFF of each light emitting element 131 to the DRV circuit 140.

As shown in FIG. 6, the DRV circuit 140 is connected to each light emitting element 131. The individual DRV circuit 140 applies an individual current to the individual light emitting element 131, respectively. The D/A conversion circuit 153 is connected to the first DRV circuit array 14L1 connected to the first light emitting element array 13L1. Similarly, the D/A conversion circuit 153 is connected to the second DRV circuit array 14L2 connected to the second light emitting element array 13L2.

A horizontal synchronization signal S3, an image data write clock C, and first light emitting element image data DL1 and second light emitting element image data DL2 in synchronization with the image data write clock C are transmitted to the light emitting element address counter 151 through the connector 16.

The horizontal synchronization signal S3 is used to reset a count value by the light emitting element address counter 151. The light emitting element address counter 151 counts the image data write clock C.

The count value by the light emitting element address counter 151 indicates which one of the light emitting elements 131 the image data included in the first light emitting element image data DL1 and the second light emitting element image data DL2 corresponds to. The count value by the light emitting element address counter 151 is output to the decoder (selector) 152.

The D/A conversion circuit 153 outputs an analog signal at a level corresponding to input light emitting data to the DRV circuit 140 as the light emitting level signal S2.

The decoder (selector) 152 sets the selection signal S1 of the DRV circuit 140 connected to a light emitting element 131 designated by the count value to "L" level. When the selection signal S1 of the DRV circuit 140 becomes "L" level, the capacitor 142 in each DRV circuit 140 keeps at an analog signal level.

The light emitting element 131 connected to the DRV circuit 140 emits light at a light intensity corresponding to the analog signal level held in the capacitor 142 of the DRV circuit 140.

Even after the selection signal S1 becomes "H" level, the light emitting element 131 continuously emits light in accordance with the analog signal level held in the capacitor 142.

If the image data is non-emission data, for example, the data input to the D/A conversion circuit 153 is "00", and the potential of the capacitor 142 reaches a level at which the light emitting element 131 does not emit light. In this way, the light emitting intensity of the light emitting element 131 is controlled.

Figure 7:
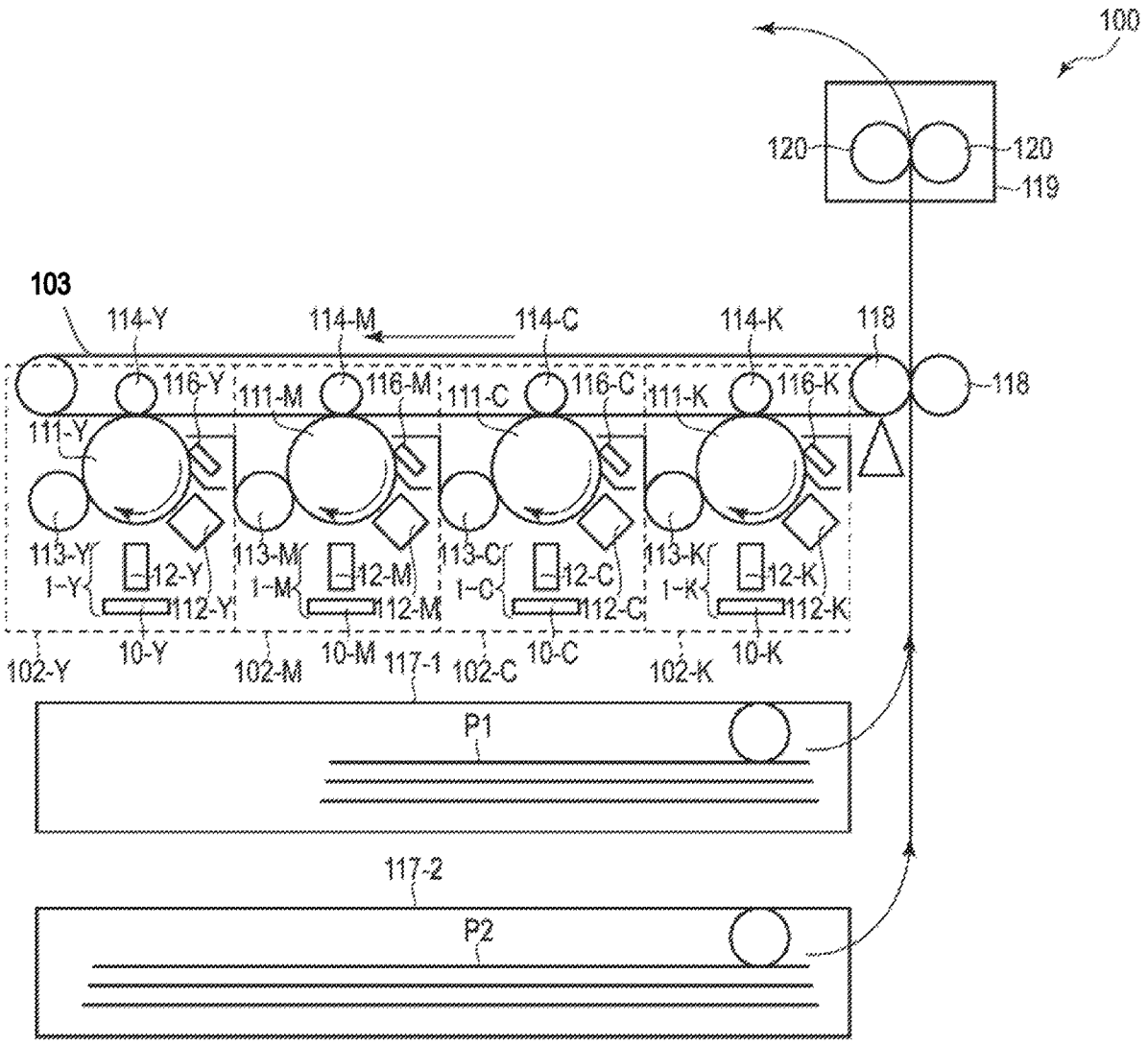
FIG. 7 is a diagram illustrating an image forming apparatus to which the print head according to the present embodiment is applied.

FIG. 7 is a diagram illustrating an example of an image forming apparatus to which the print head according to the present embodiment is applied. FIG. 7 shows an example of a quadruple tandem type color image forming apparatus, but the print head 1 of the present embodiment may also be applied to a monochrome image forming apparatus.

As shown in FIG. 7, for example, the image forming apparatus 100 includes an image forming unit 102-Y that forms a yellow (Y) image, an image forming unit 102-M that forms a magenta (M) image, an image forming unit 102-C that forms a cyan (C) image, and an image forming unit 102-K that forms a black (K) image. The image forming units 102-Y, 102-M, 102-C and 102-K form the yellow image, the cyan image, the magenta image and the black image, respectively, and transfer the images onto a transfer belt 103. Thereby, a full color image is formed on the transfer belt 103.

The image forming unit 102-Y includes an electrostatic charger 112-Y, a print head 1-Y, a developing device 113-Y, a transfer roller 114-Y and a cleaner 116-Y around an organic photoconductor 111-Y. The image forming units 102-M, 102-C and 102-K have the same configuration as described above.

In FIG. 7, a reference symbol of "-Y" is assigned to each component of the image forming unit 102-Y that forms the yellow (Y) image. A reference symbol of "-M" is assigned to each component of the image forming unit 102-M that forms the magenta (M) image. A reference symbol of "-C" is assigned to each component of the image forming unit 102-C that forms the cyan (C) image. A reference symbol of "-K" is assigned to each component of the image forming unit 102-K that forms the black (K) image.

The electrostatic chargers 112-Y, 112-M, 112-C and 112-K uniformly charge the organic photoconductors 111-Y, 111-M, 111-C and 111-K, respectively. The print heads 1-Y, 1-M, 1-C and 1-K expose the organic photoconductors 111-Y, 111-M, 111-C and 111-K respectively with the light emitted from the light emitting elements 131 of the first light emitting element array 13L1 and the second light emitting element array 13L2, respectively. By exposing the organic photoconductors 111-Y, 111-M, 111-C and 111-K, electrostatic latent images are formed on the organic photoconductors 111-Y, 111-M, 111-C and 111-K, respectively. The developing device 113-Y, 113-M, 113-C and 113-K respectively attach a yellow toner, a magenta toner, a cyan toner and a black toner to electrostatic latent images on the organic photoconductors 111-Y, 111-M, 111-C and 111-K, respectively (i.e., develop the electrostatic latent images).

The transfer rollers 114-Y, 114-M, 114-C and 114-K transfer the toner images developed on the organic photoconductors 111-Y, 111-M, 111-C and 111-K onto the transfer belt 103. The cleaners 116-Y, 116-M, 116-C and 116-K clean the toner remaining on the organic photoconductors 111-Y, 111-M, 111-C and 111-K, and then waits for next image formation.

A sheet (image forming medium) P1 having a first size (small size) is accommodated in a sheet cassette 117-1 serving as a sheet supply module. A sheet (image forming medium) P2 having a second size (large size) is accommodated in a sheet cassette 117-2 serving as a sheet supply module.

An image forming position (an image forming range in the main scanning direction MD) is necessarily changed in accordance with a sheet size. The change in the image forming position is described in detail below.

The toner image is transferred from the transfer belt 103 onto the sheet P1 or P2 taken out of the sheet cassette 117-1 or 117-2 by a transfer roller pair 118 serving as a transfer module. The sheet P1 or P2 onto which the toner image is transferred is heated and pressed by a fixing roller 120 of a fixing section 119. The toner image is firmly fixed to the sheet P1 or P2 through the heat and pressure applied by the fixing roller 120. An image forming operation is continuously performed by repeating the above processing operation.

Figure 8:
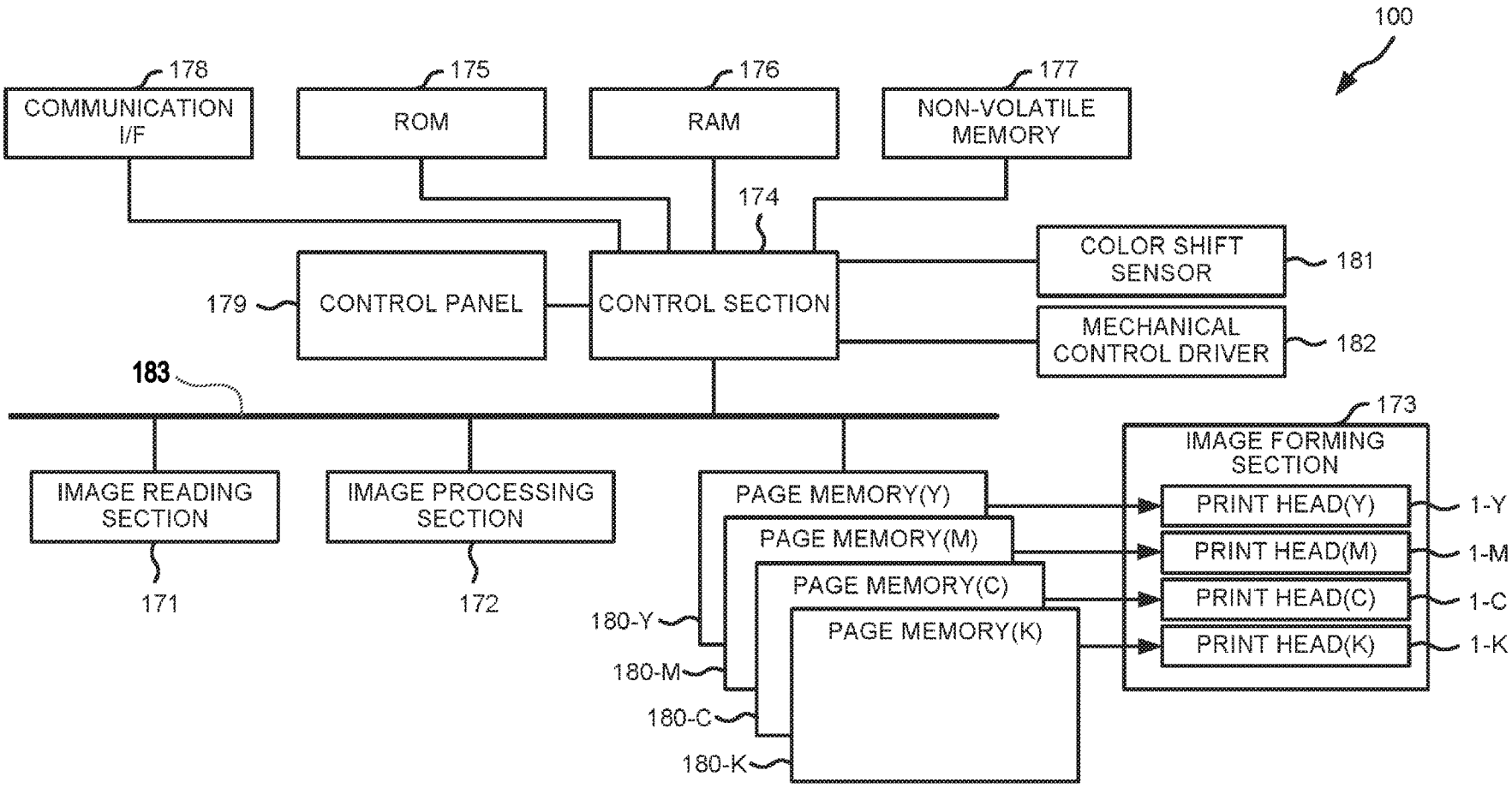
FIG. 8 is a block diagram illustrating an example of a control system of the image forming apparatus according to the embodiment.

FIG. 8 is a block diagram illustrating a control system of the image forming apparatus according to the embodiment. As shown in FIG. 8, the image forming apparatus 100 includes an image reading section 171, an image processing section 172, an image forming section 173, a control section 174, a ROM (Read Only Memory) 175, a RAM (Random Access Memory) 176, a non-volatile memory 177, a communication I/F 178, a control panel 179, page memories 180-Y, 180-M, 180-C and 180-K, a color shift sensor 181, and a mechanical control driver 182. The image forming section 173 includes the image forming units 102-Y, 102-M, 102-C and 102-K.

The ROM 175, the RAM 176, the non-volatile memory 177, the communication I/F 178, the control panel 179, the color shift sensor 181 and the mechanical control driver 182 are connected to the control section 174.

The image reading section 171, the image processing section 172 and page memories 180-Y, 180-M, 180-C and 180-K are connected to an image data bus 183. The print heads 1-Y, 1-M, 1-C and 1-K are correspondingly connected to the page memories 180-Y, 180-M, 180-C and 180-K, respectively.

The control section 174 includes one or more processors, and controls an image reading operation, an image processing operation and an image forming operation (including control of emission of light from the light emitting element) by executing various programs stored in at least one of the ROM 175 and the non-volatile memory 177.

The ROM 175 stores various programs and the like necessary for control performed by the control section 174. Various programs include a first control program for performing a first light emitting control of controlling emission of light from the plurality of light emitting elements 131, and a second control program for performing a second light emitting control of controlling emission of light from the plurality of light emitting elements 131.

For example, by executing the control program (the light emitting control), the control section 174 selects either one of a first mode and a second mode, and executes the selected mode. The control section 174 executes the first mode to set a current value for enabling the light emitting element 131 to emit light for a first irradiation time at a first light quantity (first energy) per unit area in the DRV circuit 140, and controls the emission of light from the plurality of light emitting elements 131 through the DRV circuit 140. Thereby, the light emitting element 131 emits light for the first irradiation time at the first light quantity per unit area to expose the organic photoconductor 111. The control section 174 executes the second mode to set a current value for enabling the light emitting element 131 to emit light for a second irradiation time longer than the first irradiation time at a second light quantity (second energy lower in the absolute value than the first energy) less than the first light quantity per unit area in the DRV circuit 140, and controls the emission of light from the plurality of light emitting elements 131 through the DRV circuit 140. Thereby, the light emitting element 131 emits light for the second irradiation time at the second light quantity per unit area to expose the organic photoconductor 111.

The RAM 176 temporarily stores data necessary for the control performed by the control section 174. The non-volatile memory 177 stores the updated program, various parameters, and the like. The non-volatile memory 177 may store a part or all of various programs.

The mechanical control driver 182 controls operations of motors or the like necessary for printing according to an instruction from the control section 174. The communication I/F 178 outputs various kinds of information to an external device, and receives input of various kinds of information from the external device. For example, the image forming apparatus 100 prints image data input via the communication I/F according to a printing function. The control panel 179 receives an operation input from a user or a service person.

The image reading section 171 optically reads an image of a document to acquire image data, and outputs the image data to the image processing section 172. The image processing section 172 performs various image processing (including a correction processing and the like) on the image data input via the communication I/F 178 or the image data from the image reading section 171. The page memories 180-Y, 180-M, 180-C and 180-K store the image data processed in the image processing section 172. The control section 174 controls storage of the image data in the page memories 180-Y, 180-M, 180-C and 180-K so as to fit the print position and the print head. The image forming section 173 forms an image based on the image data stored in the page memories 180-Y, 180-M, 180-C and 180-K. The image forming section 173 also includes print heads 1-Y, 1-M, 1-C and 1-K.

The control section 174 inputs a test pattern on the page memories 180-Y, 180-M, 180-C and 180-K to forma test pattern. The color shift sensor 181 detects a test pattern formed on the transfer belt 103 and outputs a detection signal to the control section 174. The control section 174 can recognize a positional relationship of the test patterns in respective colors from the input of the color shift sensor 181.

The control section 174 selects the sheet cassette 117-1 or 117-2 that feeds the sheet used for forming an image through the mechanical control driver 182.

[Light Emitting Control]

Figure 9:
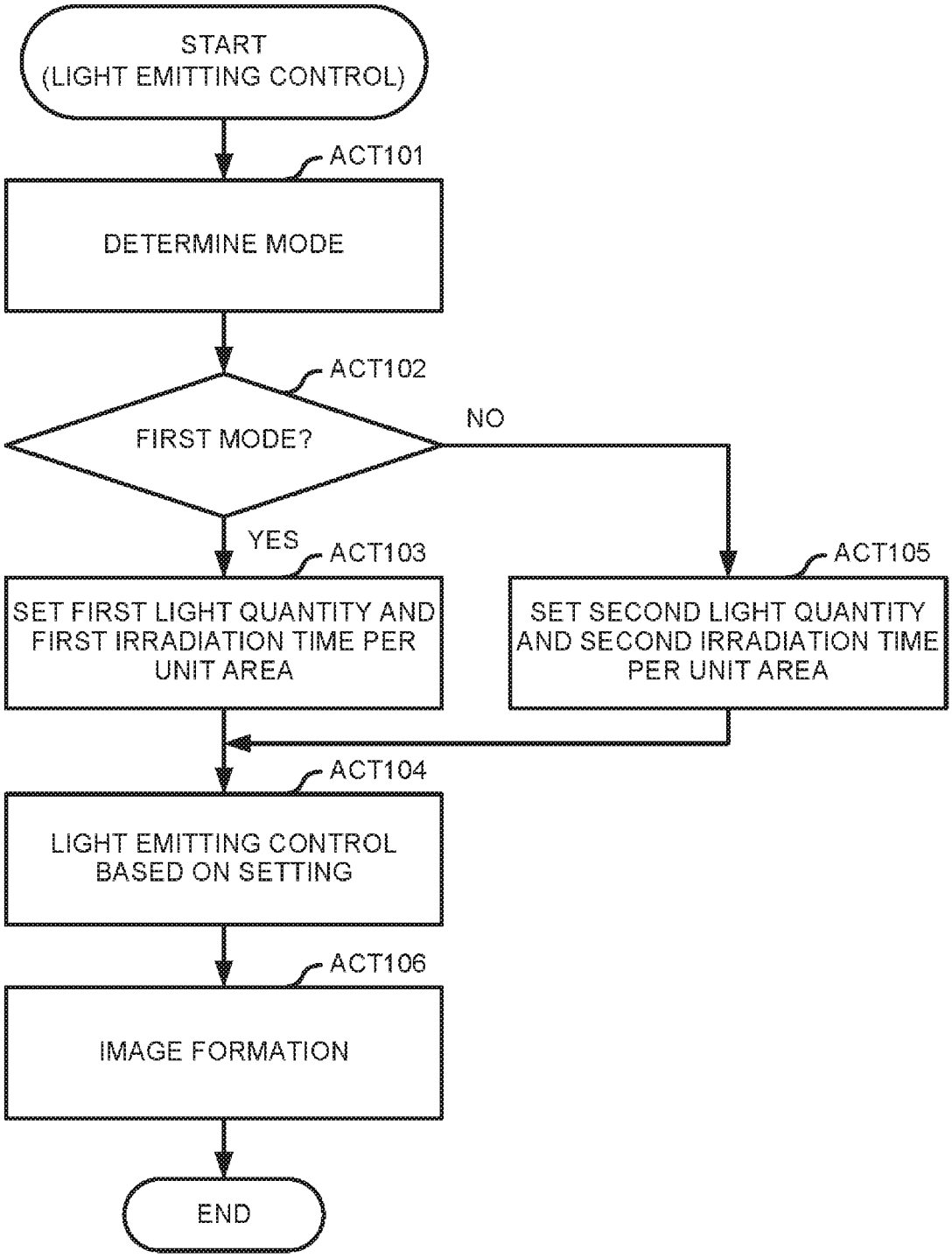
FIG. 9 is a flowchart depicting procedures of a light emitting control and image formation by the image forming apparatus (control section) according to the embodiment.

Next, with reference to FIG. 9, the control of emission of the light from the light emitting element of the print head according to the embodiment is described.

In the print head using the organic EL luminescence material, the light quantity is lower as compared with the LED, and if the light quantity is set to a large value, the lifetime of the print head tends to be short. The print head using the organic EL luminescence material has such a characteristic that the light quantity gradually decreases (attenuates) immediately after the start of emission of the light due to continuous emission of the light, and is gradually stabilized over several tens of seconds. The characteristic is described in detail below. For this reason, if an image is printed by exposing the organic photoconductor at the light quantity corresponding to the half exposure by the print head, there is a case in which an image having density difference is printed despite that images having the same density (e.g., halftone image patterns) are intended to be printed at plural positions on one page. For example, there is a case in which the density of the halftone image pattern immediately after the emission of light based on the solid image pattern is not the same as that of the halftone image pattern that is not immediately after the emission of light based on the solid image pattern.

In the present embodiment, the control section 174 can control the emission of light by executing the control program, and selectively execute the first mode in which the density variation is suppressed and the image quality is prioritized and the second mode in which the lifetime is prioritized. Alternatively, the first mode or the second mode may be fixedly executed. For example, the control section 174 may fixedly execute the second mode.

Here, the first mode and the second mode are described in detail.

An attenuation amount of the light quantity of the light emitting element 131 is substantially constant regardless of the absolute value of the light quantity. The attenuation in the light quantity tends to recover if the light emission is paused for a certain time period. Therefore, the control section 174 executes the first mode and sets the current value such that the absolute value of the light quantity increases in the DRV circuit 140 to reduce the influence of the attenuation in the light quantity, and then reduces a light emitting duty ratio to obtain a downtime. The light emitting duty ratio indicates a ratio of light emitting time in the sub scanning direction orthogonal to the main scanning direction in which the plurality of the light emitting elements 131 is arranged. In other words, the control section 174 controls the emission of light from the light emitting element 131 in such a manner that the light emitting element 131 emits light for the first irradiation time at the first light quantity per unit area according to the image data and the selection of the first mode. Thus, the image quality can be prioritized.

The control section 174 executes the second mode and sets the current value such that the absolute value of the light quantity is reduced in the DRV circuit 140, and further increases the light emitting duty ratio. In other words, the control section 174 controls the emission of light from the light emitting element 131 in such a manner that the light emitting element 131 emits light for the second irradiation time longer than the first irradiation time at the second light quantity of which the absolute value is smaller than that of the first quantity per unit area according to the image data and the selection of the second mode. Thus, the lifetime can be prioritized.

For example, one dot or a plurality of dots constituting an image corresponding to image data is set as the unit area. Alternatively, one page on which an image corresponding to the image data is printed may be set as the unit area. Thereby, the image quality per unit area can be adjusted.

FIG. 9 is a flowchart depicting procedures of the light emission control and the image formation performed by the image forming apparatus (the control section) according to the embodiment.

For example, the control panel 179 displays a mode setting screen for receiving setting of any one of the first mode, the second mode and an automatic mode. A user or an operator can set any one of the first mode, the second mode and the automatic mode through the mode setting screen, and the non-volatile memory 177 stores the set mode. The control panel 179 may functionally display the first mode as an image mode, a photo mode or an image quality prioritizing mode on the mode setting screen, and may functionally display the second mode as a character mode or a long life mode.

The control section 174 executes the light emission control by executing the program stored in the ROM 175. The control section 174 detects an instruction for outputting an image based on the image data acquired or input through the communication I/F 178 or the image data acquired or input by the image reading section 171, and determines the mode (ACT 101). The control section 174 selects the first mode if the first mode (i.e., the image mode, the photo mode or the image quality prioritizing mode) is set in the non-volatile memory 177 (Yes in ACT 102). The control section 174 selects the second mode if the second mode (i.e., the character mode or the long life mode) is set in the non-volatile memory 177 (No in ACT 102).

If the automatic mode is set in the non-volatile memory 177, the control section 174 analyzes the image corresponding to the image data, determines the type of the image, and selects either one of the first mode and the second mode according to the determination result. For example, the control section 174 selects the first mode according to the determination result indicating a photo or the like (Yes in ACT 102). The control section 174 selects the second mode (character mode or long life mode) according to the determination result indicating a character or the like (No in ACT 102). The control section 174 may store a light emitting prediction (an integration of the light quantity and the light emitting time) of each light emitting element 131 based on the image data in the non-volatile memory 177, and may select the first mode in a case in which the emission of light at a certain level or higher is predicted, or select the second mode in a case in which the emission of light below a certain level is predicted. As a result, the image formation can be performed in an appropriate mode according to the type of the image, and both the high image quality and the long life can be realized.

Alternatively, the control section 174 may store light emitting history (an integration of the light quantity and the light emitting time) of each light emitting element 131 based on the image data in the non-volatile memory 177, and may select the mode according to a light emitting load derived from the integration of the light quantity and the light emitting time. The control section 174 may select the second mode if the light emitting load is higher than a reference value, or select the first mode if the light emitting mode is equal to or less than the reference value. Thereby, the high image quality and the long life can be maintained in a well-balanced manner.

Alternatively, the control section 174 may select the mode according to a combination of several conditions. For example, the control section 174 selects either one of the first and second modes according to the determination result relating to the type of the image if the light emitting load is equal to or less than a reference value, or selects the second mode regardless of the determination result relating to the type of the image if the light emitting load is higher than the reference value.

The control section 174 sets the current value such that the light emitting element 131 emits light for the first irradiation time at the first light quantity per unit area based on the acquired image data and the selection of the first mode in the DRV circuit 140 (ACT 103), and controls the emission of light from the light emitting element 131 through the DRV circuit 140 (ACT 104). Thereby, the light emitting element 131 emits light for the first irradiation time at the first light quantity per unit area, and exposes the organic photoconductor 111 charged to the reference potential (for example, about −500 v). The image forming section 173 forms a toner image corresponding to the image data based on the electrostatic latent image held due to the decrease in the potential of the organic photoconductor 111 by the emission of light from the plurality of light emitting elements 131 (ACT 106).

Alternatively, the control section 174 sets the current value such that the light emitting element 131 emits light for the second irradiation time longer than the first irradiation time at the second light quantity of which the absolute value is smaller than that of the first quantity per unit area according to the acquired image data and the selection of the second mode in the DRV circuit 140 (ACT 105), and controls the emission of light from the light emitting element 131 through the DRV circuit 140 (ACT 104). Thereby, the light emitting element 131 emits light for the second irradiation time at the second light quantity per unit area, and exposes the organic photoconductor 111 charged to the reference potential. The image forming section 173 forms a toner image corresponding to the image data based on the electrostatic latent image held due to the decrease in the potential of the organic photoconductor 111 by the emission of light from the plurality of light emitting elements 131 (ACT 106).

It can be said that the ratio of the light emitting time (light emitting duty ratio) in the sub scanning direction orthogonal to the main scanning direction in which the plurality of the light emitting elements 131 is arranged is different in the first mode and the second mode. Specifically, the control section 174 controls the emission of light from the light emitting element 131 such that the ratio of the light emitting time in the sub scanning direction is higher in the second mode than in the first mode. For example, in the first mode, the light emitting duty ratio per unit area (one dot) is set to 12%, and the light quantity is set to 100 nW. On the other hand, in the second mode, the light emitting duty ratio per unit area is set to 60%, and the light quantity is set to 20 nW. As a result, the image quality can be prioritized in the first mode and the lifetime of the head can be prioritized in the second mode while the light quantity per unit area keeps substantially unchanged.

[Image Quality Improvement]

Figure 10:
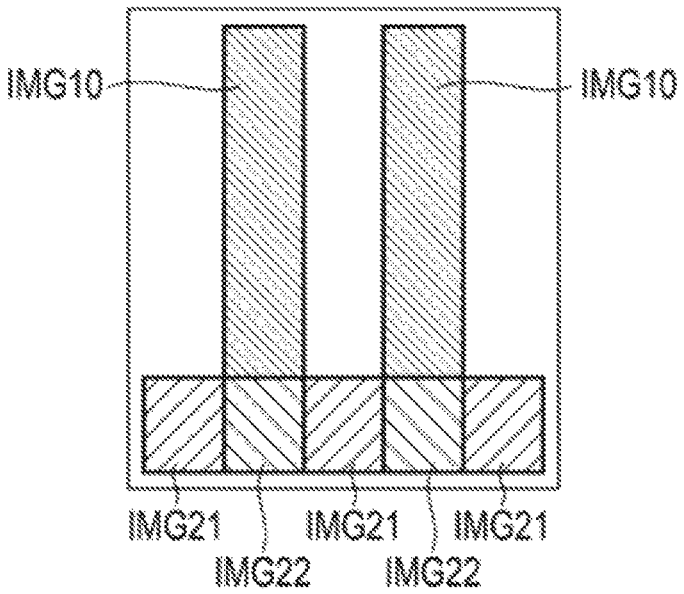
FIG. 10 is a diagram illustrating a density difference occurring in a halftone image pattern immediately after emission of light based on a solid image pattern and a halftone image pattern not immediately after the emission of light based on the solid image pattern.

FIG. 10 is a diagram illustrating a density difference between the halftone image pattern immediately after emission of light based on the solid image pattern and the halftone image pattern not immediately after emission of light based on the solid image pattern. As shown in FIG. 10, there is a case in which a density difference (density unevenness) occurs between an area for a halftone image pattern IMG22 immediately after the emission of light based on the solid image pattern IMG10 and an area for a halftone image pattern IMG21 not immediately after the emission of light based on the solid image pattern IMG10.

Figure 11:
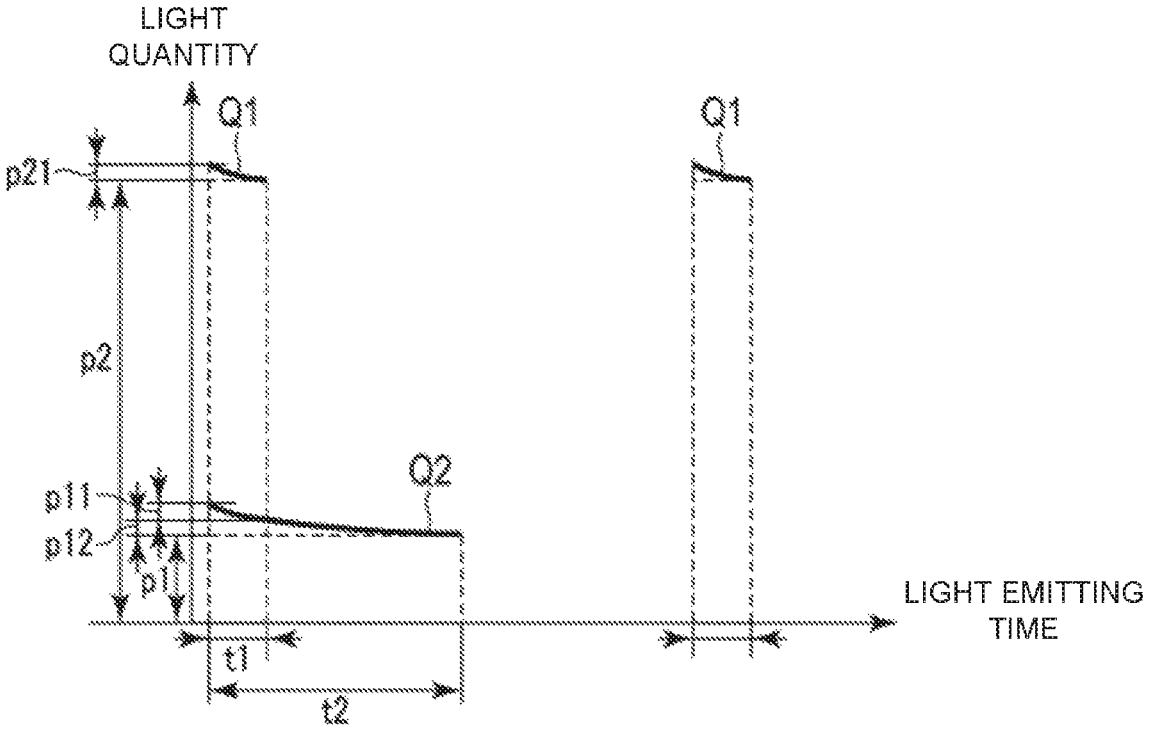
FIG. 11 is a diagram illustrating luminescence characteristics of the print head according to the embodiment.

FIG. 11 is a diagram illustrating luminescence characteristics of the print head according to the embodiment. In FIG. 11, a vertical axis indicates the light quantity, and a horizontal axis indicates a light emitting time. As shown in FIG. 11, it can be seen that the energy attenuates with time although a certain current is applied to the print head 1.

A light quantity Q1 in FIG. 11 is set to be about four times a light quantity Q2, but the both light quantity attenuates immediately after the start of energization, and although the absolute values of the both light quantity are different, an attenuation amount p21 and an attenuation amount p11 at a certain time t1 are almost the same. Such phenomenon causes the density unevenness between the halftone images IMG21 and IMG22 shown in FIG. 11, and the following (1) and (2) can be understood according to the graph.

(1) The attenuation amount of the light quantity is almost constant regardless of the absolute value of the light quantity (2) Attenuation of light quantity tends to recover if the emission of light is paused for a certain time period Specifically, it can be seen that the influence of the attenuation in the light quantity can be reduced as a result if the downtime is obtained as much as possible and the light quantity is set as large as possible at the time of light emission when an image is formed. However, the quantity of light that can be emitted in the case of the organic EL material is smaller than that in the case of the LED material, and if the current is increased to increase the absolute value of the light quantity, the material rapidly deteriorates even if the light emitting time is set to be shorter accordingly. As a result, there is a possibility that the irreversible light quantity attenuation is increased and the life is shortened. Therefore, it is not appropriate to increase the light quantity unnecessarily. Furthermore, in the electrophotographic apparatus, a level of density unevenness may change even in the setting of the light quantity for the organic photoconductor 111.

Figures 12, 13:
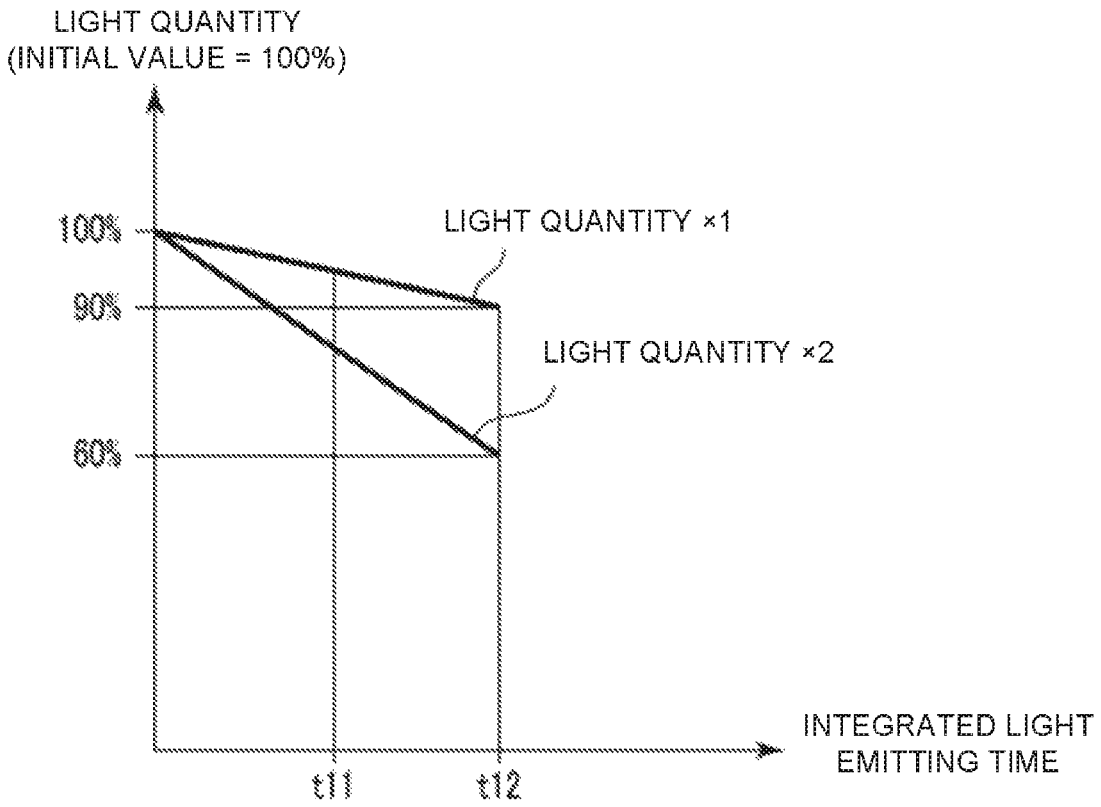
FIG. 12 is a diagram illustrating lifetime characteristics of organic EL material.
FIG. 13 is a diagram illustrating an image forming result in each mode by the image forming apparatus according to the embodiment.

FIG. 12 is a diagram illustrating an example of the lifetime characteristics of the organic EL material.

As shown in FIG. 12, measurement results relating to the attenuation characteristics for a reference first light quantity (light quantity x1) and a second light quantity (light quantity x2) twice the first light quantity are obtained. A vertical axis in FIG. 12 indicates a light quantity ratio when an initially set light quantity of the first or second light quantity is set to 100%, and a horizontal axis indicates an integrated light emitting time. As shown in FIG. 12, even if the integrated light quantity is substantially the same, the larger the set value of the light quantity is, the larger a light attenuation amount becomes (the shorter the lifetime becomes). Even if the emission of light is stopped for a certain period of time, the attenuated light quantity does not recover. In the organic EL print head 1, the device lifetime can be extended by reducing the light quantity and prolonging the light emitting time.

FIG. 13 is a diagram illustrating an example of an image formation result in each mode by the image forming apparatus according to the embodiment. As shown in FIG. 13, under the condition of the first mode, the density unevenness does not occur in the halftone, but when a running test is carried out under that condition, the light quantity decreases by 1% after printing of 100,000 sheets (no recovery). On the other hand, under the condition of the second mode, the density unevenness occurs in the halftone, but when the running test is carried out under that condition, the reduction in the light quantity is less than 0.1% even after the printing of 100,000 sheets.

As described above, in the print head and the image forming apparatus according to the present embodiment, by selecting one of the first and second modes, the image quality can be prioritized or the lifetime can be prioritized.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. A print head, comprising:

a light emitting element array comprising a polysilicon transistor and a plurality of light emitting elements that emit light at a luminance corresponding to an output current of the polysilicon transistor; and a processor configured to select either one of a first mode in which the plurality of light emitting elements emits light for a first irradiation time at a first light quantity per unit area and a second mode in which the plurality of light emitting elements emits light for a second irradiation time longer than the first irradiation time at a second light quantity less than the first light quantity per unit area, and control emission of light from the plurality of light emitting elements to expose a photoconductor according to acquired image data and a selected mode.

2. The print head according to claim 1, wherein one dot constituting an image corresponding to the acquired image data is set as the unit area.

3. The print head according to claim 1, wherein a plurality of dots constituting an image corresponding to the acquired image data is set as the unit area.

4. The print head according to claim 1, wherein a ratio of light emitting time in a sub scanning direction orthogonal to a main scanning direction in which the plurality of light emitting elements is higher in the second mode than in the first mode.

5. The print head according to claim 1, wherein the processor selects the first mode based on a setting of an image quality prioritizing mode.

6. The print head according to claim 1, wherein the processor selects the second mode based on a setting of a long life mode.

7. The print head according to claim 1, wherein each of the plurality of light emitting elements comprise an organic EL luminescence material, and the photoconductor is an organic photoconductor.

8. An image forming apparatus, comprising:

a light emitting element array comprising a polysilicon transistor and a plurality of light emitting elements that emit light at a luminance corresponding to an output current of the polysilicon transistor;

a processor configured to select either one of a first mode in which the plurality of light emitting elements emits light for a first irradiation time at a first light quantity per unit area and a second mode in which the plurality of light emitting elements emits light for a second irradiation time longer than the first irradiation time at a second light quantity less than the first light quantity per unit area, and control emission of light from the plurality of light emitting elements to expose a photoconductor according to acquired image data and a selected mode; and an image forming section configured to form an image corresponding to the acquired image data based on an electrostatic latent image held on the photoconductor by emission of light from the plurality of the light emitting elements.

9. The image forming apparatus according to claim 8, wherein the processor determines a type of an image based on the acquired image data, and selects either one of the first mode and the second mode according to a determination result.

10. The image forming apparatus according to claim 9, wherein the processor selects the first mode according to a determination result indicating a photo image.

11. The image forming apparatus according to claim 9, wherein the processor selects the second mode according to a determination result indicating a character image.

12. The image forming apparatus according to claim 8, wherein one dot constituting an image corresponding to the acquired image data is set as the unit area.

13. The image forming apparatus according to claim 8, wherein a ratio of light emitting time in a sub scanning direction orthogonal to a main scanning direction in which the plurality of light emitting elements is higher in the second mode than in the first mode.

14. The image forming apparatus according to claim 8, wherein the processor selects the first mode based on a setting of an image quality prioritizing mode.

15. The image forming apparatus according to claim 8, wherein the processor selects the second mode based on a setting of a long life mode.

16. An image forming method, comprising:

selecting either one of a first mode in which a plurality of light emitting elements emits light for a first irradiation time at a first light quantity per unit area and a second mode in which the plurality of light emitting elements emits light for a second irradiation time longer than the first irradiation time at a second light quantity less than the first light quantity per unit area;

exposing a photoconductor with an emission of light from the plurality of light emitting elements according to acquired image data and the selected mode; and forming an image corresponding to the acquired image data based on an electrostatic latent image held on the photoconductor by emission of light from the plurality of the light emitting elements.

17. The image forming method according to claim 16, further comprising:

determining a type of an image based on the acquired image data, and selecting either one of the first mode and the second mode according to a determination result.

18. The image forming method according to claim 17, further comprising:

selecting the first mode according to the determination result indicating a photo image.

19. The image forming method according to claim 17, further comprising:

selecting the second mode according to the determination result indicating a character image.

20. The image forming method according to claim 16, further comprising:

selecting the first mode based on a setting of an image quality prioritizing mode or selecting the second mode based on a setting of a long life mode.

* * * * *